United States Patent [19]

Ladin

[11] Patent Number: 4,644,646

[45] Date of Patent: Feb. 24, 1987

[54] STRAP CUTTING TOOL

[76] Inventor: Eli M. Ladin, 1608 Morton Ave., Ann Arbor, Mich. 48104

[21] Appl. No.: 685,208

[22] Filed: Dec. 26, 1984

Related U.S. Application Data

[63] Continuation of Ser. No. 387,071, Jun. 10, 1982, abandoned.

[51] Int. Cl.[4] ..... B65B 7/00

[52] U.S. Cl. ..... 30/134; 30/2

[58] Field of Search ..... 30/2, 134, 135, 124, 30/173, 194; 56/328 R, 329

[56] References Cited

U.S. PATENT DOCUMENTS 2,775,032 12/1956 Sorensen ..... 30/134

3,237,302 3/1966 Fennell ..... 30/135

FOREIGN PATENT DOCUMENTS 680656 10/1952 United Kingdom ..... 30/134

*Primary Examiner*—Douglas D. Watts

*Attorney, Agent, or Firm*—Rhodes and Boller

[57] ABSTRACT

A tool for cutting tensioned strapping comprises energy absorbing structures at lateral sides of the cutting mechanism which absorb energy released in the strapping upon severing. The disclosed form is of elastomeric elements having columnar strength in the direction of force application to the strapping, yet having lateral deflection capability while compressed to absorb the energy.

4 Claims, 7 Drawing Figures

STRAP CUTTING TOOL

This application is a continuation of Ser. No. 387,071 filed June 10, 1982 now abandoned.

BACKGROUND AND SUMMARY OF THE INVENTION

This invention relates to a strap cutting tool of the type used to cut tensioned strapping and is particularly concerned with a new and improved arrangement for preventing uncontrolled release of the severed ends of the strapping upon severing.

Tensioned strapping is frequently employed for various purposes such as banding articles together for shipment. For example the strapping may be used to band together a stack of plywood sheets. In order to provide a satisfactory banding it is often necessary that substantial tension be imparted to the strapping, and therefore it is common to use metal as the strapping material. In order to tension the strapping it is also common to use powered tools which operate to tightly draw the strapping around the bundle and to secure the strapping in place. Tensions on the order of thousands of pounds can be imparted to steel strapping.

The common procedure for severing the strapping is by use of a severing tool, for example a pliers-type strap cutter. Because of the substantial tension force which can be imparted to metal strapping, care must be taken when using a severing tool because of the sudden release of tension which occurs upon severing. In the tensioned strapping, energy previously imparted to tension the strapping is stored as potential energy. Upon severing this energy is virtually instantaneously transformed into kinetic energy. The consequence is that the severed ends of the strapping separate extremely rapidly from each other in what can be an uncontrolled, violent whipping action. The particular nature of the whipping action will be a function of the tension which has been imparted to the strapping and the character of the strapping itself. If care is not exercised it is entirely possible for uncontrolled whipping of the severed ends of the strapping to be a potential source of damage and/or injury.

Previous devices have been added to strap cutting tools for the purpose of attempting to guard against uncontrolled release of the strapping upon severing. Examples are shown in U.S. Pat. Nos. 3,058,213; 3,237,302; and 3,237,303.

The present invention is directed to a new and improved strap cutting tool in which the energy of tension in the strapping which is released upon severing is absorbed before it can result in uncontrolled whipping of the severed ends of the strapping from the tool. The present invention involves the provision of energy absorbing structures, and a strategic configuration and arrangement thereof, on the strap cutting tool so that the energy which is released upon severing is substantially absorbed and dissipated by the energy absorbing structures with the result that violent uncontrolled whipping of the severed ends of the strapping is avoided. The present invention arises in part through the recognition and analysis of the detailed action which occurs in the strapping and cutting tool during the severing action. In consequence of this recognition and analysis energy absorbing structures have been created which are effective to absorb a substantial portion, indeed substantially all, of the energy which is released in the strapping upon severing so that little residual energy, if indeed any, remains in the strapping. The result is avoidance of uncontrolled whipping of the strapping out of the cutting tool.

In the preferred embodiment of the invention which is disclosed herein the energy absorbing structures comprise elastomeric elements which are mounted on the tool on lateral sides of the cutting mechanism. An opposite portion of the tool has anvil portions, and the anvil portions and the energy absorbing elastomeric elements are cooperatively arranged and constructed to forcefully hold the strapping throughout the operation of the cutting mechanism up to the point of severing, and upon severing the elastomeric elements absorb the released energy. The elastomeric elements are configured to have substantial columnar strength in the direction of force application to the strapping so that as the cutting mechanism is operated and the elastomeric elements are compressed in the direction of force application to the strapping, they retain their general configuration so as not to become unstable, much as a column subject to axial overloading might become unstable. Yet, the configuration of the elastomeric elements is such that the elements themselves also provide energy absorbing structure which absorbs the energy which is released in the strapping upon severing. This occurs with the elastomeric elements yielding laterally away from the cutting mechanism upon severing of the strapping. The elastomeric elements have friction faces which have friction contact with the strapping and the frictional forces which exist between the friction faces and the strapping result, upon severing, in the friction faces being displaced laterally with the strapping and their operation of the energy absorbing body portions of the elastomeric elements such that said body portions absorb the energy which is released in the strapping so that said energy does not appear in the form of violent uncontrolled whipping of the severed ends of the strapping from the cutting tool. With the invention a cutting tool can be used to sever strapping in which the tension can run to the order of thousands of pounds; for example as much as 6,000 pounds tension can be handled.

The cutting blade is also configured to perform a severing action which minimizes any tendency for the strapping to be ejected from the cutting mechanism by the severing action. While the invention may be practiced with other forms of cutting mechanisms, the disclosed cutting blade configuration promotes a more advantageous severing action both independently and cooperatively with the energy absorbing structure. The disclosed preferred embodiment also has certain specific constructional features which are advantageous. The invention may be embodied in a new cutting tool or can be used to modify an existing cutting tool.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
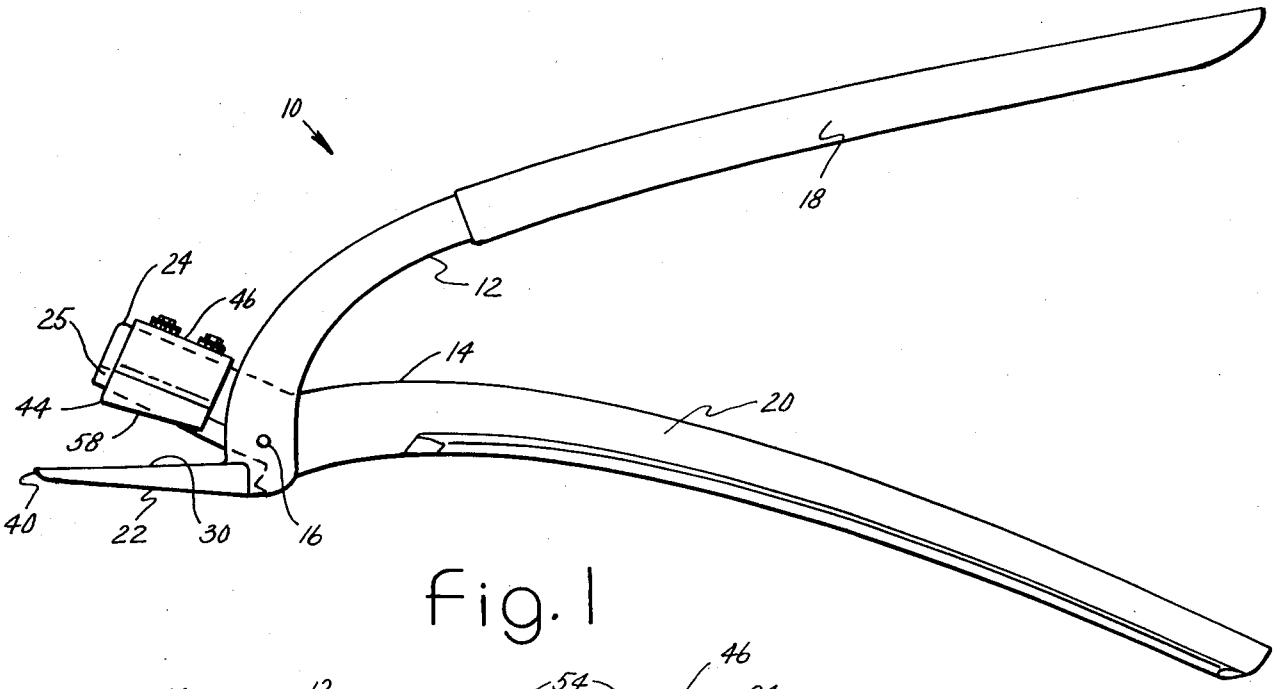
FIG. 1 is a side elevational view of a cutting tool embodying principles of the invention.
Figure 2:
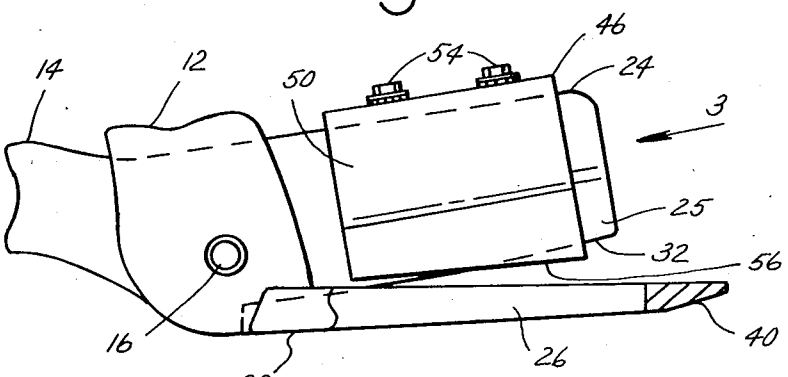
FIG. 2 is an enlarged view of a portion of FIG. 1 illustrating greater detail and having portions broken away.
Figure 3:
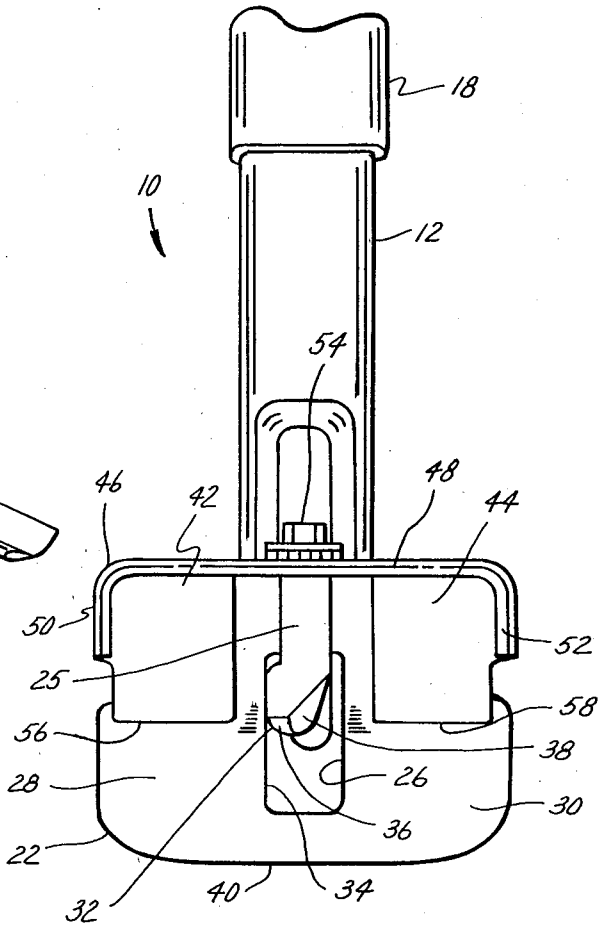
FIG. 3 is an enlarged fragmentary view taken in the direction of arrow 3 in FIG. 2.

FIGS. 1, 2 and 3 illustrate a strap cutting tool 10 embodying principles of the present invention. The strap cutting tool is a pliers-like device comprising a pair of members 12 and 14 which are pivotally connected together about a pivot 16. The members 12 and 14 comprise operating handles 18 and 20 respectively which are squeezed together from the position shown in FIG. 1 to sever strapping. The members 12 and 14 also comprise jaw portions 22 and 24 respectively, the lower jaw portion 22 being with the upper handle 18 and the upper jaw portion 24 with the lower handle 20. As the handles 18 and 20 are squeezed together, the resultant action about pivot 16 results in the jaws 24, 22 being urged together about the pivot.

The lower jaw portion 22 may be considered in general to be an anvil while the upper jaw portion 24 comprises a cutting blade 25. Member 12 comprises an aperture 26 through which member 14 passes. A major portion of this aperture lies in the lower jaw portion 22 and is of elongate shape. It is disposed centrally between anvil portions 28 and 30.

The upper jaw portion 24 comprises a cutting or severing edge 32 on blade 25 which cooperates with the left hand (FIG. 3) edge 34 of aperture 26 for cutting strapping. Thus the two edges 32 and 34 constitute the cutting mechanism. The upper surface of the lower jaw portion 22 is substantially flat, and the edge 34 is generally straight. Edge 32 is however endowed with a certain slight curvature and its curvature is convex toward edge 34. The blade is also configured with a portion 36 which will bear against the strapping over aperture 26 during the severing operation and it also includes a relief 38. The leading, or forward, edge 40 of the lower jaw portion 22 is tapered so as to allow the lower jaw to be wedged between the strapping and the stack which is banded by the strapping.

Also associated with the upper jaw element 24 are energy absorbing structures disposed to each lateral side of blade 25. In the disclosed embodiment the energy absorbing structures are provided by elastomeric elements, or pads, 42 and 44 respectively which mount on the cutting tool by means of a metal support 46. Each element 42, 44 is associated with a respective anvil portion 28 and 30, and is of generally rectangular overall shape. Support 46 comprises a main laterally extending support portion 48 with right angle flanges 50 and 52 at the lateral ends of the main portion 48. These flanges 50 and 52 are directed toward the lower jaw portion 22. The support 46 comprises a pair of holes at the center, and fasteners 54 pass through these holes into corresponding tapped holes in the upper surface of the upper jaw portion 24 to secure the support in place on member 14. The support is fastened to member 14 after the two members 12 and 14 have been assembled by passing blade 25 through aperture 26 and pivotally connecting the two members at 16. As can be seen in FIGS. 1 and 2 the elements 42, 44 are to a certain extent co-extensive with the cutting edges 32, 34 in length. The lower surfaces 56, 58 of the respective elements 42, 44 are friction faces which are adapted to contact the strapping during operation of the cutting tool. (The cutting operation will be explained in greater detail later with reference to the subsequent drawing figures.) The friction faces 56, 58 are at the free ends of the elastomeric elements relative to their attachment to support 46. In this regard the mounting of the elastomeric elements to the metal support 46 may be accomplished in conventional fashion through suitable molding and bonding techniques. The elastomeric elements are suitably bonded or otherwise secured to the support 46 at the common surface portions. Each element 42, 44 is laterally confined by the corresponding flange 50, 52 for a portion of the element's height. This leaves the lower portion of each element free of lateral confinement so that the lower portion of each elastomeric element may be considered as projecting freely from the support.

The elastomeric elements are configured to possess columnar stability in the direction in which they apply force to the strap being cut (i.e. in the direction of their height). This is accomplished in part through a suitable selection of the elastomeric material and in this regard the material may have a generally uniform compressibility throughout. It is also accomplished in part through suitable dimensioning of the elements. In addition to their columnar strength, the elements are configured to possess a yieldable resiliency which allows a certain lateral deformation, or deflection, of the free end of each elastomeric element which accomplishes energy absorption upon severing of the strapping. Greater detail of the severing operation and the action of the cutting tool and its energy absorbing elements can be seen in connection with FIGS. 4 through 7.

Figure 4:
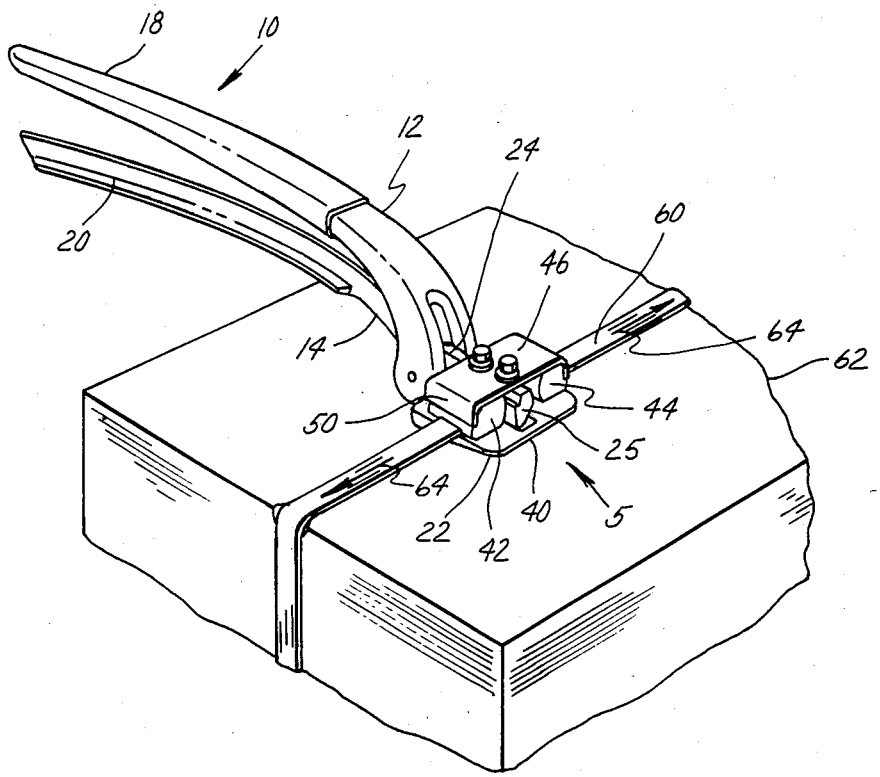
FIG. 4 is a perspective view illustrating usage of the cutting tool.
Figure 6:
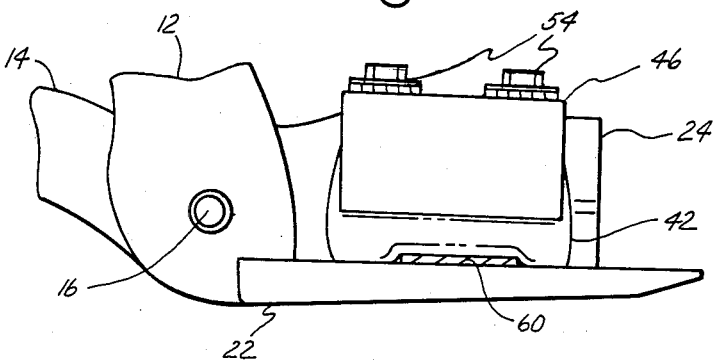
FIG. 6 is a side elevational view taken in the direction of arrows 6—6 in FIG. 5.
Figure 5:
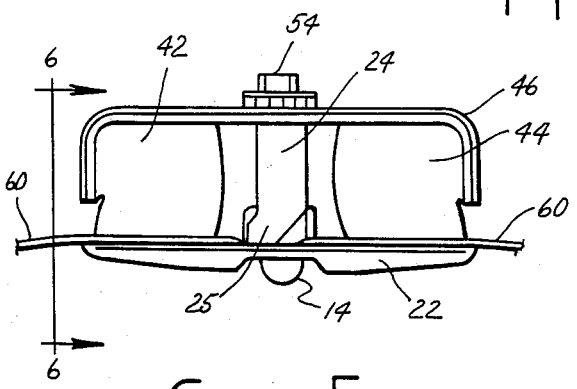
FIG. 5 is a view taken in the direction of arrow 5 in FIG. 4, and enlarged.

FIG. 4 illustrates the cutting tool in the process of cutting a piece of metal strapping 60 banding a stack of sheets 62 together. As the handles of the tool are squeezed together, the friction faces 56, 58 of the respective elastomeric elements 42, 44 engage the strapping. Because of the columnar stability of the elastomeric elements, they do not buckle as an overloaded column might, but rather tend to yieldably deform in the manner shown in FIGS. 5 and 6. As the compression increases due to increasing squeezing of the handles, the edges 32, 34 operate to cut the strapping. For the typical strapping which is encountered the elastomeric elements will be compressed forcefully against the strapping with any overlap being against the underlying anvil portions. As the cut is being made, the tension in the strapping has an inherent tendency toward release. Thus the action of the strapping is such that the ends adjacent the line of severing want to move out of engagement with the cutting tool in the direction of the arrows 64 in FIG. 4. However because of the forceful action of the elastomeric elements on the strapping, the outward force in the strapping is reacted by the elastomeric elements. The configuration of the elastomeric elements is such that they deflect, or deform, laterally away from the cutting mechanism and in so doing they absorb the kinetic energy which is imparted to the strapping upon severing. Because of the forceful clamping action exerted by the elastomeric elements on the strapping the kinetic energy is reacted and absorbed by the elastomeric elements with the result that the strapping undergoes a slight lateral displacement which relieves the tension but with the energy being absorbed in the lateral deflection, or deformation, of the elastomeric elements. Thus the severed ends of the strapping do not whip in uncontrolled fashion out of the cutting tool.

Figure 7:
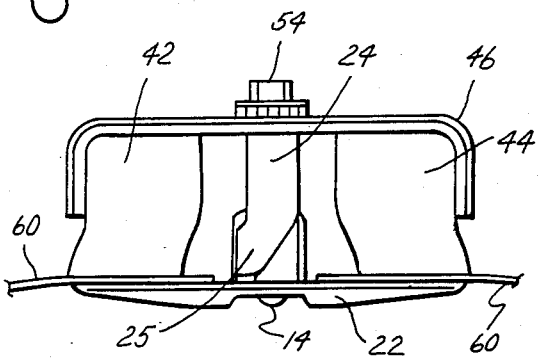
FIG. 7 is a view similar to FIG. 5 illustrating a further operating condition.

FIG. 7 illustrates a condition which is exemplary of that after severing has been completed. It can be seen that the free ends of the elastomeric elements are deflected outwardly away from the cutting mechanism but with the friction faces being in contact with the severed ends of the strapping. Upon full release of the tool the elastomeric elements return toward their free undeformed condition, and it will be appreciated that the cutting tool has therefore reacted, absorbed, and dissipated the energy of tension which was released upon severing.

While principles of the invention are applicable to various specific embodiments, details of the illustrated embodiment are of interest. It is designed to handle tensile forces from 100 to 6000 pounds. Each pad may deflect laterally at the free end up to 0.250 inch. The overall dimensions of each pad in the free condition are approximately 1 inch by $\frac{3}{4}$ inch by $\frac{1}{2}$ inch. The friction faces 56, 58, while being flat, are not truly perpendicular to the side surface of their elements 42, 44, and are designed to act against the anvil portions 28, 30 in engaging the strapping. They tend to come into increasing contact with the anvil in the direction from rear to front (i.e. from left to right in FIG. 2). A suitable material is 40 to 70 durometer rubber.

While a preferred embodiment of the invention has been disclosed, it will be appreciated that principles are applicable to other embodiments.

What is claimed is:

1. In a cutting tool for cutting tensioned strapping, said tool being of the type comprising a cutting mechanism operated by a pair of handles which are squeezed together to sever the strapping, said cutting mechanism comprising a blade operated by one of said handles, the improvement for absorbing energy which is released upon severing of the strapping which comprises anvil portions associated with the other of said handles and disposed on the cutting tool at lateral sides of the cutting mechanism, resiliently compressible energy absorbing structures in the form of elastomeric bodies of generally uniform compressibility throughout disposed at lateral sides of the cutting mechanism blade said mounting means comprising a laterally extending support member attached to said blade, mounting means for mounting said energy absorbing structures on said blade, said anvil portions and said energy absorbing structures being cooperatively arranged and constructed to forcefully hold the strapping on lateral sides of the cutting mechanism as the handles are operated to sever the strapping with said energy absorbing structures resiliently compressing in the process, said energy absorbing structures having proximal portions disposed against said support member and distal portions projecting from said proximal portions toward said anvil portions, said distal portions projecting freely of said proximal portions and of said support member, said distal portions terminating in friction faces which engage the strapping and press it against said anvil portions and said energy absorbing structures having the areas of expanse of their friction faces so proportioned relative to the extent of the free projections of their distal portions from their proximal portions as to be endowed with columnar stability in the direction in which they apply force to the strapping throughout operation of the cutting mechanism to sever the strapping such that said energy absorbing structures bulge outwardly as they resiliently compress in pressing the strapping against said anvil portions, and upon severing of the strapping said energy absorbing structures absorbing a substantial portion of the energy released in the severed strapping by lateral yielding away from the cutting mechanism while still bulging outwardly and forcefully holding in cooperation with the anvil portions the severed ends of the strapping.

2. The improvement set forth in claim 1 in which said energy absorbing structures are of generally rectangular shapes.

3. The improvement set forth in claim 1 in which said laterally extending support member comprises a main laterally extending support portion laterally spanning the blade and flanges at the lateral ends of said main support portion projecting toward the anvil portions in laterally spaced relation to the blade, each energy absorbing structure's proximal portion being disposed on the support member against both the main laterally extending support portion and the corresponding flange and said energy absorbing structures being spaced laterally of the blade.

4. The improvement set forth in claim 1 in which said proximal portions project beyond said cutting mechanism blade in the direction toward said anvil portions when uncompressed.

* * * * *